US008499740B2

(12) United States Patent
Yoon et al.

(10) Patent No.: US 8,499,740 B2
(45) Date of Patent: Aug. 6, 2013

(54) ENGINE BRAKING SYSTEM FOR VEHICLES

(75) Inventors: Seock Joong Yoon, Seoul (KR); Kyung Mo Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 511 days.

(21) Appl. No.: 12/775,212

(22) Filed: May 6, 2010

(65) Prior Publication Data

US 2011/0067673 A1 Mar. 24, 2011

(30) Foreign Application Priority Data

Sep. 22, 2009 (KR) ..... 10-2009-0089600

(51) Int. Cl.
*F02D 13/04* (2006.01)
*F01M 9/10* (2006.01)

(52) U.S. Cl.
USPC ..... 123/321; 123/90.39

(58) Field of Classification Search
USPC ..... 123/321, 322, 90.36
See application file for complete search history.

(56) References Cited

U.S. PATENT DOCUMENTS 5,477,824 A * 12/1995 Reedy ..... 123/322
5,564,385 A 10/1996 Hakansson
5,586,532 A 12/1996 Faletti et al.
5,957,097 A 9/1999 Schanz
5,975,251 A 11/1999 McCarthy
6,244,257 B1 6/2001 Hu
6,253,730 B1 * 7/2001 Gustafson ..... 123/321
6,257,201 B1 7/2001 Kajiura et al.
6,314,926 B1 * 11/2001 Meneely et al. ..... 123/90.16
6,334,429 B1 1/2002 Little, Jr.
6,354,254 B1 * 3/2002 Usko ..... 123/90.16
6,386,160 B1 * 5/2002 Meneely et al. ..... 123/90.16
6,394,050 B1 5/2002 McCarthy et al.
6,394,067 B1 5/2002 Usko et al.
6,405,707 B1 6/2002 Feucht
6,422,186 B1 * 7/2002 Vanderpoel ..... 123/90.15
6,594,996 B2 * 7/2003 Yang ..... 123/321
6,691,674 B2 * 2/2004 McCarthy et al. ..... 123/321
7,140,333 B2 * 11/2006 Persson et al. ..... 123/90.16
7,392,772 B2 7/2008 Janak et al.

(Continued)

FOREIGN PATENT DOCUMENTS

JP 57-105510 A 7/1982
JP 1-177401 A 7/1989

(Continued)

*Primary Examiner* — Stephen K Cronin
*Assistant Examiner* — Arnold Castro
(74) *Attorney, Agent, or Firm* — Morgan, Lewis & Bockius LLP

(57) ABSTRACT

An engine braking system for vehicles may include a rocker shaft having a lubricating oil passage and a braking oil passage, a valve unit selectively supplying part of the oil supplied to the lubricating oil passage, into the braking oil passage, and at least one exhaust rocker arm, into which the rocker shaft is inserted and pivotal about the rocker shaft, wherein the at least one exhaust rocker arm has, therein, a first connection passage communicating with the braking oil passage and a first recess, a stopper fixed above the first recess, and an actuator housed in the first recess and including a pressing piston, wherein the pressing piston moves to contact the stopper by hydraulic pressure of the oil supplied from the braking oil passage into the first recess and thus presses the at least one exhaust rocker arm in a downward direction.

13 Claims, 9 Drawing Sheets

U.S. PATENT DOCUMENTS

| | | | | |
|---|---|---|---|---|
| 7,520,262 | B2 * | 4/2009 | Jeong et al. | 123/321 |
| 7,673,600 | B2 * | 3/2010 | Yang | 123/90.16 |
| 7,984,705 | B2 * | 7/2011 | Yang | 123/321 |
| 8,065,987 | B2 * | 11/2011 | Yang | 123/321 |
| 8,210,144 | B2 * | 7/2012 | Langewisch | 123/90.22 |
| 8,240,278 | B2 * | 8/2012 | Jeon et al. | 123/90.12 |
| 2003/0024501 | A1 * | 2/2003 | McCarthy et al. | 123/321 |
| 2005/0274341 | A1 | 12/2005 | Usko et al. | |
| 2006/0081213 | A1 * | 4/2006 | Yang et al. | 123/321 |
| 2007/0144472 | A1 | 6/2007 | Yang | |
| 2007/0175441 | A1 * | 8/2007 | Jeong et al. | 123/321 |
| 2007/0193543 | A1 | 8/2007 | Best | |
| 2009/0139486 | A1 * | 6/2009 | Wagner | 123/321 |
| 2010/0037854 | A1 | 2/2010 | Yang | |
| 2010/0307451 | A1 * | 12/2010 | Lee et al. | 123/321 |
| 2010/0319657 | A1 * | 12/2010 | Dodi et al. | 123/321 |
| 2011/0023821 | A1 * | 2/2011 | Yoon et al. | 123/321 |
| 2011/0073068 | A1 * | 3/2011 | Yoon et al. | 123/321 |
| 2011/0114060 | A1 * | 5/2011 | Jeon et al. | 123/321 |
| 2011/0132298 | A1 * | 6/2011 | Ruggiero et al. | 123/90.12 |
| 2011/0220061 | A1 * | 9/2011 | Wiley et al. | 123/321 |

FOREIGN PATENT DOCUMENTS

| | | | |
|---|---|---|---|
| JP | 5-285558 | A | 11/1993 |
| JP | 6-10640 | A | 1/1994 |
| JP | 9-177635 | A | 7/1997 |
| JP | 2001-263017 | A | 9/2001 |
| JP | 2002-510008 | A | 4/2002 |
| JP | 2005-180195 | A | 7/2005 |
| JP | 2006-161596 | A | 6/2006 |
| JP | 2007-64107 | A | 3/2007 |
| KR | 2003-0062676 | A | 7/2003 |
| KR | 10-2007-0012536 | A | 1/2007 |
| KR | 10-0732445 | B1 | 6/2007 |
| KR | 10-2010-0064783 | A | 6/2010 |
| WO | WO 99/50108 | | 10/1999 |

* cited by examiner (a) (b)

ENGINE BRAKING SYSTEM FOR VEHICLES

CROSS REFERENCE TO RELATED APPLICATION

The present application claims priority to Korean Patent Application Number 10-2009-0089600 filed on Sep. 22, 2009, the entire contents of which application is incorporated herein for all purposes by this reference.

BACKGROUND OF THE INVENTION

1. Field of the Invention

The present invention relates to an engine braking system for vehicles and, more particularly, to an engine braking system for vehicles, in which an actuator and a control valve are integrated to a corresponding exhaust rocker arm, thereby reducing weight and improving braking performance.

2. Description of Related Art

In general, an engine brake is designed to brake a vehicle in such a manner that a gear ratio of gears is subject to downward adjustment. Since a shifting step is downwardly adjusted, this braking overloads each part of the engine to reduce the lifespan of the engine.

Thus, there has been provided an engine braking system that improves an engine braking effect by keeping part of the exhaust port of a cylinder open to prevent a compression stroke from taking place.

However, this engine braking system separately requires a housing in which an engine brake module is installed, and thus weight and cost are increased. Further, another housing is provided on one side of an exhaust rocker arm in consideration of a layout, and a piston presses one side of a valve bridge. As such, only one of multiple valves is adapted to be kept open, so that the performance of the engine brake is low.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine braking system for vehicles, which minimizes the complexity of the configuration, reduces weight and cost, and opens two exhaust valves coupled to the same valve bridge to improve the performance of an engine brake.

In an aspect of the present invention, the engine braking system for vehicles, may include a rocker shaft having a lubricating oil passage and a braking oil passage therein in an axial direction thereof, wherein oil for lubricating engine parts on operating an engine flows through the lubricating oil passage and oil for operating an engine braking flows through the braking oil passage, a valve unit selectively supplying part of the oil supplied to the lubricating oil passage, into the braking oil passage, and at least one exhaust rocker arm, into which the rocker shaft is inserted and pivotal about the rocker shaft to selectively press an exhaust valve, wherein the at least one exhaust rocker arm has, therein, a first connection passage communicating with the braking oil passage and a first recess formed in the at least one exhaust rocker arm, a stopper fixed above the first recess of the at least one exhaust rocker arm with a predetermined gap therebetween, and an actuator housed in the first recess and including a pressing piston, wherein the pressing piston moves to contact the stopper by hydraulic pressure of the oil supplied from the braking oil passage into the first recess and thus presses one side of the at least one exhaust rocker arm in a downward direction.

The actuator may further include a main elastic member elastically supporting the pressing piston toward a first channel formed in the at least one exhaust rocker arm and connecting the first connection passage and the first recess, wherein the pressing piston includes a reservoir therein, a check ball disposed in the reservoir of the pressing piston and selectively movable to open or close a gate of the first connection passage, a sub-elastic member disposed in the reservoir of the pressing piston and elastically supporting the check ball toward the gate of the first connection passage, and a first fixing member formed in an upper circumference of the first recess and supporting the main elastic member to prevent the main elastic member and the pressing piston from being separated from the first recess.

The first fixing member may include a first snap ring seated and fixed in a groove formed in an upper circumference of the first recess.

The at least one exhaust rocker arm may include a first discharge passage communicating with the first recess and the outside, and a control valve unit opening or closing the first discharge passage so as to selectively discharge the oil in the first recess to the outside according to the hydraulic pressure of the oil in the first connection passage, wherein the control valve unit is disposed in a second recess formed in the at least one exhaust rocker arm and passing through the first discharge passage to intersect therebetween, and wherein the first recess and the first discharge passage communicate through a second connection passage formed in the at least one exhaust rocker arm, wherein a second channel is formed between the second recess and the first connection passage and the hydraulic pressure of the oil in the first connection passage is applied to the control valve unit through the second channel, and wherein the second recess is disposed closer to the braking oil passage than the first recess is The control valve unit may include a control piston slidably disposed in the second recess and moving in a lengthwise direction thereof to selectively open or close the first discharge passage according to the hydraulic pressure of the oil in the first connection passage, the hydraulic pressure being applied to the control piston through the second channel, an elastic member disposed in the second recess and applying an elastic force to the control piston in a direction where the control piston opens the first discharge passage, and a second fixing member fastening the elastic member in the second recess and having a second discharge passage to selectively discharge the oil supplied from the first recess to the outside.

The second fixing member may include a plate having a hole therein to form the second discharge passage and supporting the elastic member downwards in the second recess to prevent the elastic member and the control piston from being separated from the second recess, and a second snap ring seated in a groove formed in an upper circumference of the second recess, and supporting the plate.

In another aspect of the present invention, the stopper may be fixed to at least one holder provided separately so as to be disposed apart from an upper end face of the pressing piston with the predetermined gap, and the stopper may be integrally formed with a screw screwed to the at least one holder such that the predetermined gap between an end of the stopper and the upper end face of the pressing piston can be adjusted, wherein at least two holders are integrally connected and mounted on a cylinder head.

The rocker shaft may includes a flow-through passage formed in a direction intersecting with the axial direction of the lubricating oil passage, and connected to the valve unit, and an additional passage formed in a direction intersecting with the axial direction of the braking oil passage, and connected to the valve unit.

The first connection passage may communicate with the braking oil passage through an auxiliary passage formed in the rocker shaft.

According to exemplary embodiments of the present invention as set forth above, with use of the engine braking system, since each actuator is integrated to the corresponding exhaust rocker arm, all the actuators of the exhaust rocker arms are driven by one solenoid valve, so that weight and cost can be reduced.

Further, each exhaust rocker arm itself presses and opens all opposite exhaust valves, so that the performance of the engine braking system is improved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Hereinafter, an engine braking system for vehicles according to various embodiments of the present invention will be described in detail with reference to the accompanying drawings.

Figure 1:
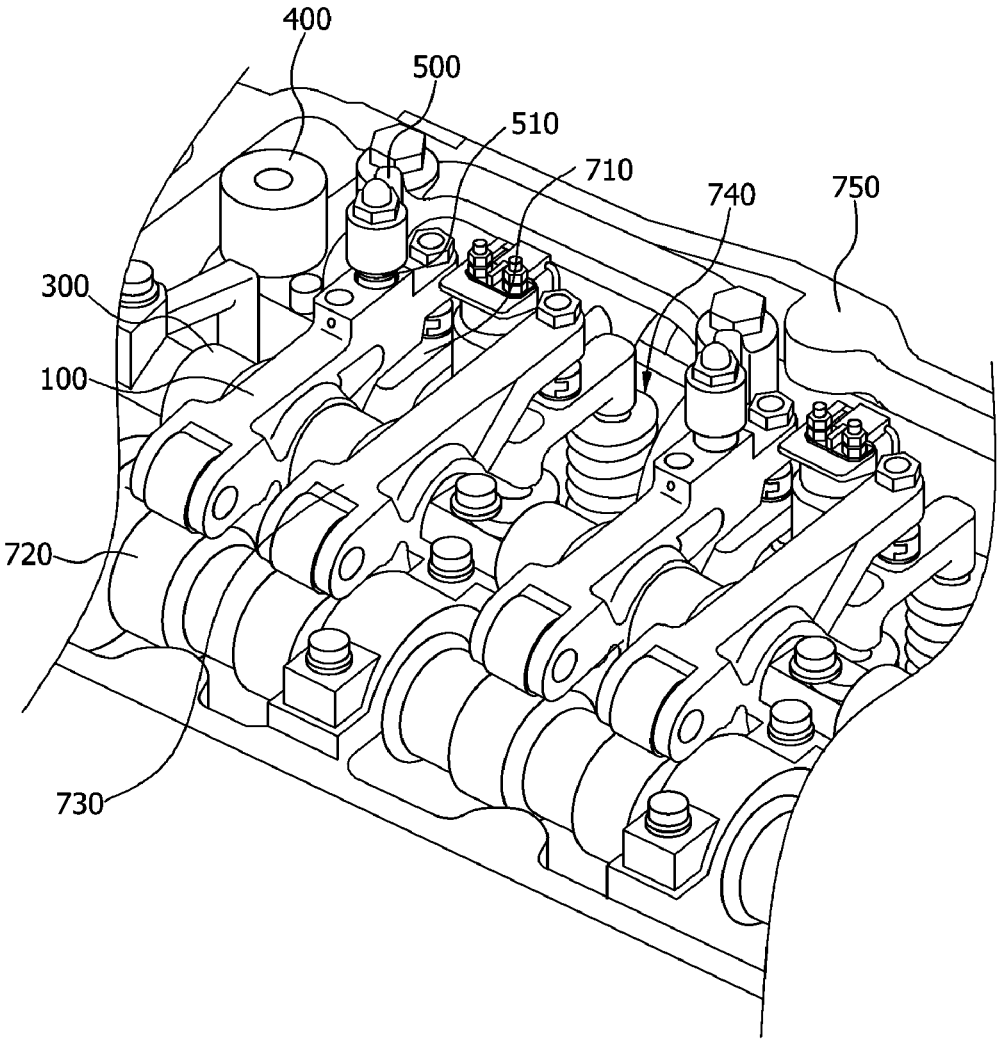
FIG. 1 is a perspective view illustrating an exemplary engine mounting an engine braking system for vehicles according to the present invention.
Figure 2:
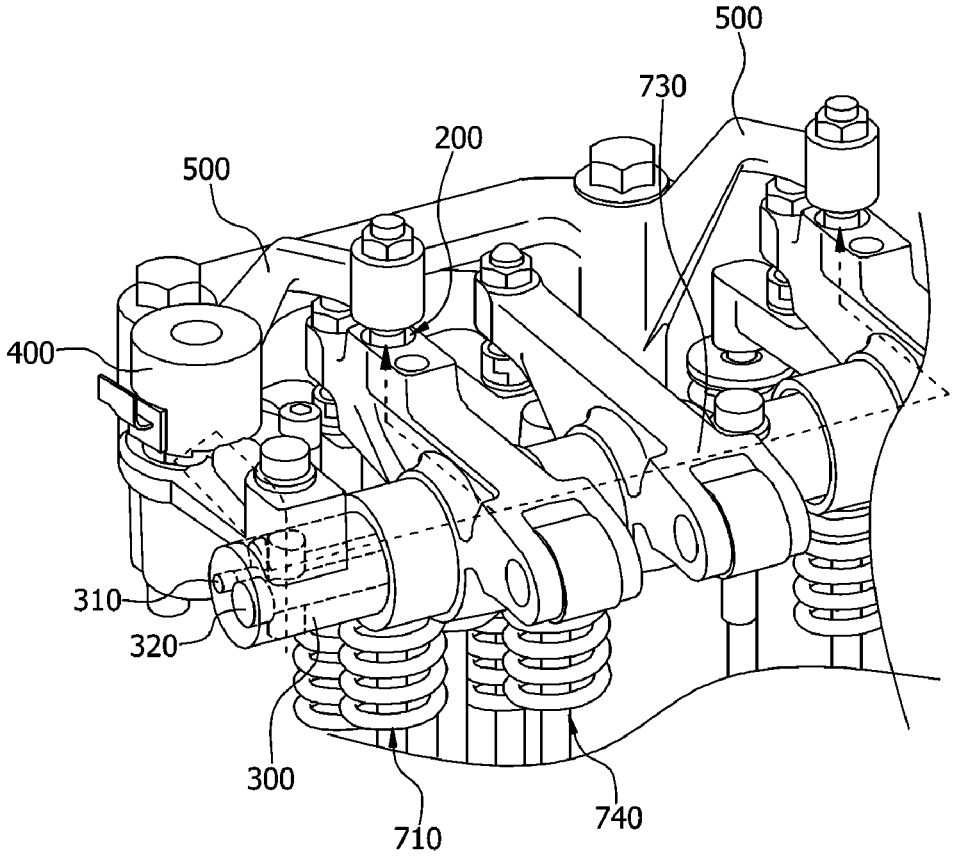
FIG. 2 is a perspective view illustrating an exemplary engine braking system for vehicles according to the present invention.
Figure 3A:
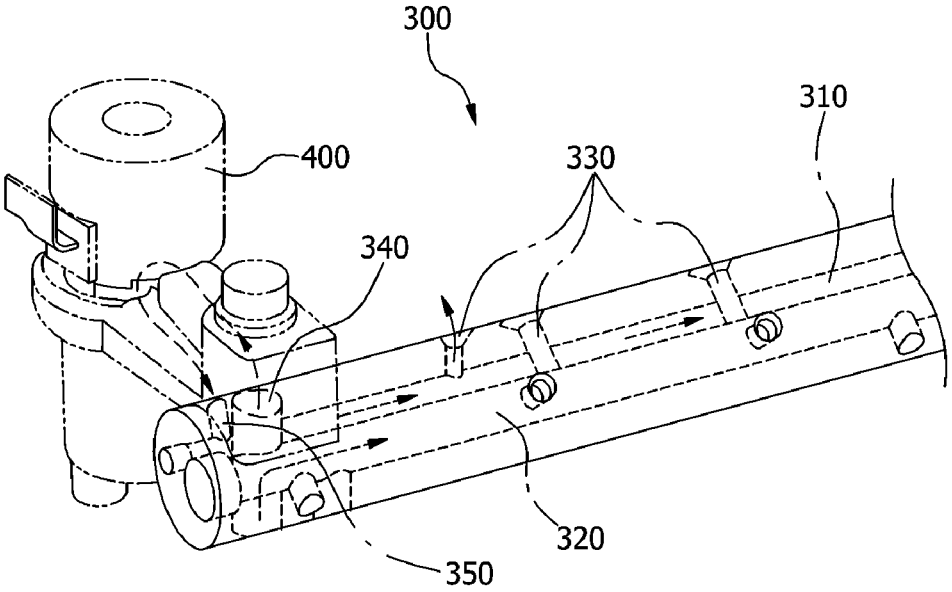
FIGS. 3A through 3C are perspective views illustrating a rocker shaft, a holder on which a stopper is mounted, and an exhaust rocker arm in an exemplary engine braking system for vehicles according to the present invention.
Figure 3B:
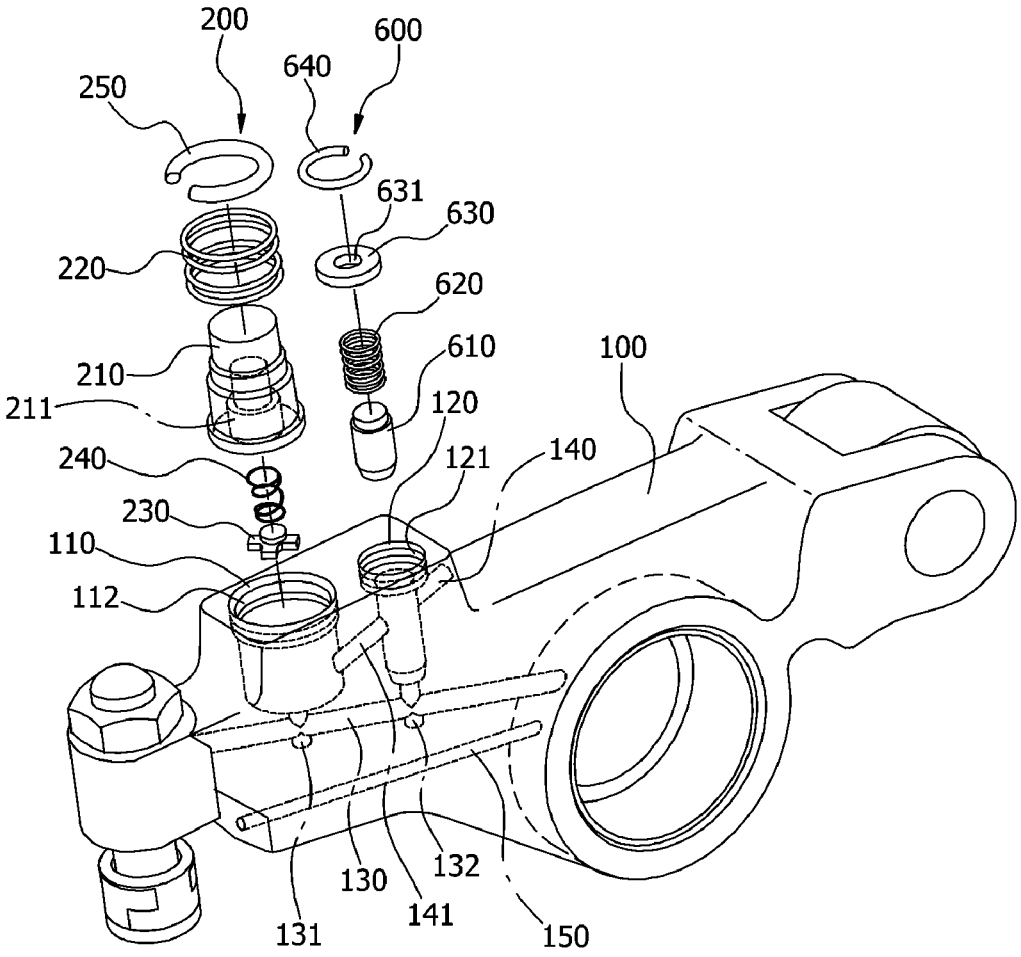
Figure 3C:
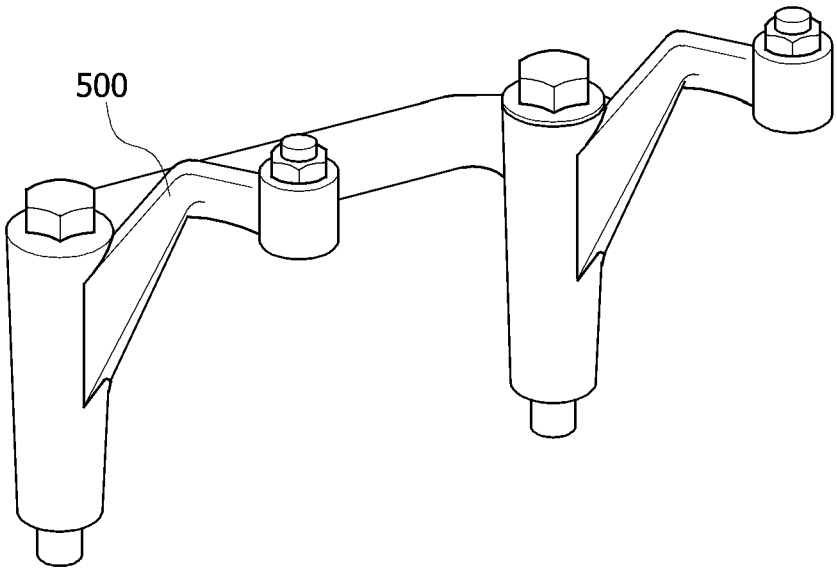
Figure 4A:
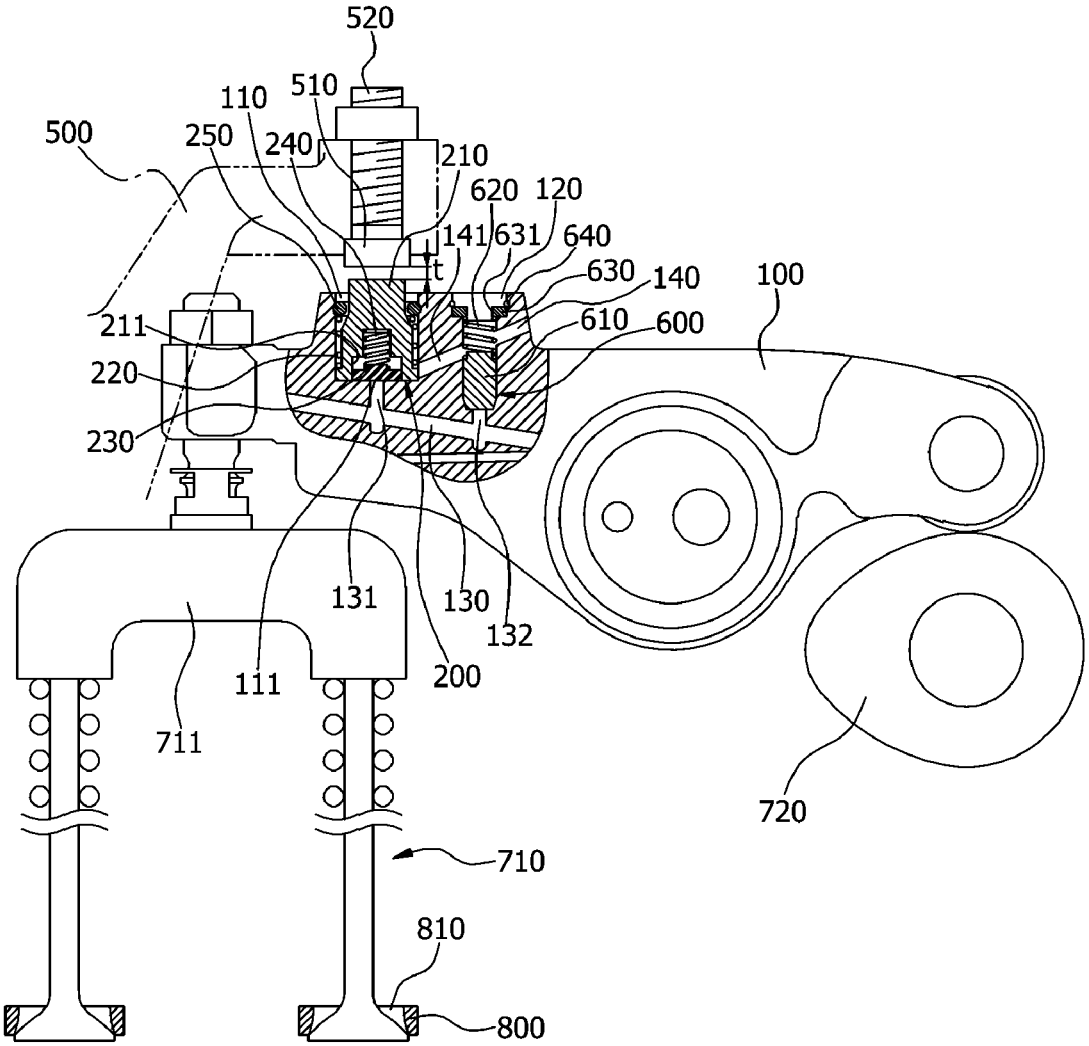
FIGS. 4A and 4B are partial cross-sectional views illustrating an exhaust rocker arm in an exemplary engine braking system for vehicles according to the present invention.
Figure 4B:
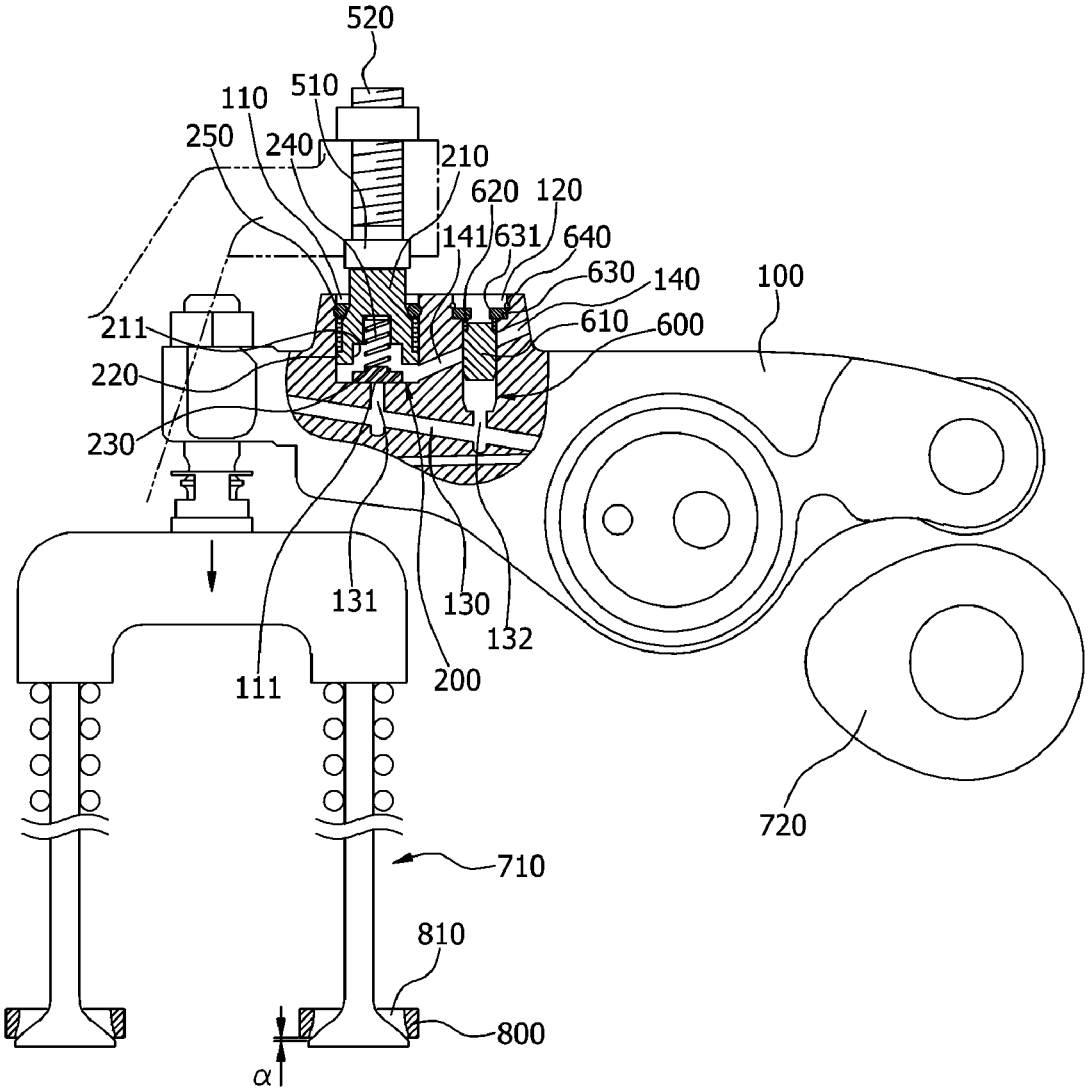

FIG. 1 is a perspective view illustrating an engine mounting an engine braking system for vehicles according to an exemplary embodiment of the present invention. FIG. 2 is a perspective view illustrating an engine braking system for vehicles according to an exemplary embodiment of the present invention. FIGS. 3A through 3C are perspective views illustrating a rocker shaft, a holder on which a stopper is mounted, and an exhaust rocker arm in an engine braking system for vehicles according to an exemplary embodiment of the present invention. FIGS. 4A and 4B are partial cross-sectional views illustrating an exhaust rocker arm in an engine braking system for vehicles according to an exemplary embodiment of the present invention.

The engine braking system for vehicles according to an exemplary embodiment of the present invention includes a rocker shaft 300 in which a lubricating oil passage 320 and a braking oil passage 310 are formed so as to have a length in an axial direction, a solenoid valve 400 controlling the supply of oil to the braking oil passage 310, and a plurality of exhaust rocker arms 100 set in angular motion about the rocker shaft 300 and pressing corresponding exhaust valves 710. The engine braking system further include actuators 200 and stoppers 510 such that the exhaust rocker arms 100 press the exhaust valves 710 regardless of rotation of cams 720 when the oil is supplied to the braking oil passage 310.

The rocker shaft 300 is provided therein with the lubricating oil passage 320 and the braking oil passage 310 having the length in the axial direction. The lubricating oil passage 320 communicates with supply passages 150 formed in the exhaust and intake rocker arms 100 and 730 into which the rocker shaft 300 is inserted. The lubricating oil passage 320 is connected with the supply passages 150 by auxiliary passages 330 formed in a direction intersecting with the axial direction of the lubricating oil passage 320.

The oil flowing into the lubricating oil passage 320 flows through the supply passages 150 to contact points between the exhaust and intake rocker arms 100 and 730 and the exhaust and intake valves 710 and 740, thereby reducing friction between the rocker arms 100 and 730 and the valves 710 and 740. In addition, the rocker shaft 300 has the auxiliary passages 330, through which the lubricating oil passage 320 is connected to parts other than the exhaust and intake rocker arms 100 and 730. Thereby, the oil is supplied to the parts other than the valves, and thus the parts are prevented from being damaged by friction.

Further, the rocker shaft 300 also includes a flow-through passage 340, which passes through the lubricating oil passage 320 and is connected to the side of the solenoid valve 400 such that part of the oil flowing into the lubricating oil passage 320 is supplied to the solenoid valve 400. Here, it is preferable that the lubricating oil passage 320 has substantially the same diameter as the flow-through passage 340, and thus no difference between an amount of the oil flowing into the lubricating oil passage 320 and an amount of the oil flowing into the flow-through passage 340 occurs.

Meanwhile, the braking oil passage 310 communicates with connection passages 130 formed in the exhaust rocker arms 100 into which the rocker shaft 300 is inserted. The braking oil passage 310 is connected with the connection passages 130 by the auxiliary passages 330 formed in a direction intersecting with the axial direction of the braking oil passage 310. The oil flowing into the braking oil passage 310 flows through the connection passages 130 into recess 110 of the exhaust rocker arms which will be described below, and then operates the actuators 200.

Further, the oil flowing into the braking oil passage 310 is supplied through the solenoid valve 400. When a driver operates the engine braking system, the solenoid valve 400 is operated to supply the oil to the braking oil passage 310. To this end, the rocker shaft 300 further includes a additional passage 350 formed in the direction intersecting with the axial direction of the braking oil passage 310 such that the solenoid valve 400 is connected with the braking oil passage 310.

The exhaust rocker arms 100 are set in angular motion about the rocker shaft 300 by the cams 720, and press the exhaust valves 710. Preferably, when the engine braking system is operated, an external force is applied to the exhaust rocker arms 100 so as to keep the exhaust valves 710 open, so that the exhaust rocker arms 100 press the exhaust valves 710.

Here, since the exhaust valves 710 are plural in number, the exhaust valves are connected with valve bridges 711, and are simultaneously pressed by the exhaust rocker arms 100, each of which presses the center of each valve bridge 711. In this manner, the exhaust valves 710 are pressed at the same time, so that the performance of the engine braking system is improved.

For this operation, each exhaust rocker arm 100 is configured such that the recess 110, in which the actuator 200 is located, is formed therein on one side where it presses the exhaust valve 710, and such that the stopper 510 is fixed above the recess 110.

Each actuator 200 includes a pressing piston 210, a main elastic member 220 pressing the pressing piston 210 toward a first channel 131, a check ball 230 opening or closing a gate 111 of the recess, a sub-elastic member 240 pressing the check ball 230 toward the first channel 131, and a snap ring 250 preventing separation of the main elastic member 220 from the exhaust rocker arm 100.

The pressing piston 210 having a cylindrical shape so as to be in close contact with an inner circumference of the recess 110 moves in a lengthwise direction of the recess 110, so that it is contacted with and separated from the stopper 510.

Further, the pressing piston 210 is elastically supported toward the first channel 131 by the main elastic member 220, and thus is displaced downwards to its original position by a restoring force of the main elastic member 220 when a hydraulic pressure of the oil is released in the state where the pressing piston 210 is displaced upwards.

In the actuator 200, the check ball 230 opens or closes the gate 111 of the recess. The pressing piston 210 is provided with a reservoir 211 in which the braking oil is primarily stored when the check ball 230 opens the gate 111 of the recess.

Thus, the check ball 230 moves in the reservoir 211 in a lengthwise direction of the reservoir 211, thereby opening or closing the gate 111 of the recess. Due to the sub-elastic member 240 between the ceiling of the reservoir 211 and the check ball 230, the cheek ball 230 is pressed toward the gate 111 of the recess.

With this configuration, when the driver operates the engine braking system, the solenoid valve 400 is operated, and thus the oil flows into the braking oil passage 310. Then, when the oil flows into the recess 110 through the braking oil passage 310 and the connection passages 130, the pressing piston 210 of each actuator 200 which is located in the recess 110 is displaced upwards by a gap t or more between the stopper 510 and the pressing piston 210.

As the pressing pistons 210 are displaced upwards and thus come into contact with the stoppers 510, the exhaust rocker arms 100 relatively moves in a direction where the exhaust valves 710 are pressed, so that exhaust ports 810 of the cylinders 800 are kept open. At this time, each exhaust valve 710 is displaced by a distance a, which is left by subtracting the gap t between the stopper 510 and the pressing piston 210 from a height to which the pressing piston 210 is raised.

Meanwhile, the driver releases the engine braking system to close the exhaust valves 710. In this case, the oil stored in the recess 110 should be discharged to the outside. To this end, discharge passages 140 are provided such that the recess 110 communicates with the outside.

Here, when the solenoid valve 40 stops supplying the oil to the braking oil passage 310 due to the release of the engine braking system, the discharge passages 400 are opened by control valves 600. Each control valve 600 is located in a second recess 120 passing through the discharge passage 140, is operated by the hydraulic pressure of the oil as in the actuator 200, and thus discharges the braking oil stored in the recess 110 to the outside of the exhaust rocker arm 100.

Meanwhile, each exhaust rocker arm 100 is provided with a second channel 132 such that the second recess 120 is connected with the connection passage 130. When flowing into the connection passage 130, the oil is supplied to the recess 110 and the second recess 120. A hydraulic pressure is generated by the supplied oil, and thus operates the actuator 200 and the control valve 600.

Each control valve 600 includes a control piston 610 displaced in a lengthwise direction of the second recess 120 by the braking oil, and an elastic member 620 applying a resilient force to the control piston 610 in a direction where the control piston 610 opens the discharge passage 140.

The control piston 610 having a cylindrical shape so as to be in close contact with an inner circumference of the second recess 120 moves in the lengthwise direction of the second recess 120 due to the hydraulic pressure of the braking oil, thereby opening or closing the discharge passage 140.

Further, the elastic member 620 is disposed between the control piston 610 and a plate 630 described below, and presses the control piston 610 toward the second channel 132, i.e. in a direction where the control piston 610 opens the discharge passage 140. When the control piston 610 is raised by the hydraulic pressure of the braking oil, the elastic member 620 is compressed, and thus the discharge passage 140 is closed by the control piston 610. When the hydraulic pressure is removed, the elastic member 620 is restored, and thus the control piston 610 is lowered.

Meanwhile, the second recess 120 is configured such that an upper portion thereof has a diameter greater than that of a lower portion thereof. The plate 630 having an outer diameter identical to the diameter of the upper portion of the second recess 120 closes the upper portion of the second recess 120. Here, the plate 630 is provided with a hole 631 in the center thereof, so that the oil flowing into the second recess 120 through the connection passage 141 can be discharged. Further, the elastic member 620 can be stably supported by the plate 630.

Furthermore, the recess 110 and the second recess 120 are provided with grooves 112 and 121 in which snap rings 250 and 640 are seated along upper inner circumferences thereof, respectively. The snap rings 250 and 640 are seated in the respective grooves 112 and 121, so that the main elastic member 220 and the plate 630 are prevented from being separated from the recess 110 and the second recess 120.

In this manner, the actuator 200 and the control valve 600 are located in the recess 110 and the second recess 120, both of which are formed in the exhaust rocker arm 100, so that a separate housing is not required, and thus cost and weight are reduced to make the layout advantageous.

Meanwhile, the stopper 510, which is located above the recess 110 of the exhaust rocker arm 100 so as to be disposed apart from an upper end face of the exhaust rocker arm 100 by a predetermined interval, is fixed to a cylinder block 750 by a holder 500 provided separately. The gap t is defined between a one end face of the stopper 510 and an upper end face of the pressing piston 210 of the actuator. In order to facilitate adjusting the gap t, the stopper 510 is integrally formed with a screw 520.

Thus, the screw 520 is screwed to the holder 500, so that the stopper 510 can be positioned above the recess 110 with the gap t in relation to the upper end face of the pressing piston 210. Further, at least two holders 500 may be integrally formed above each exhaust rocker arm 100, and be stably mounted on the cylinder head 750.

Figure 5:
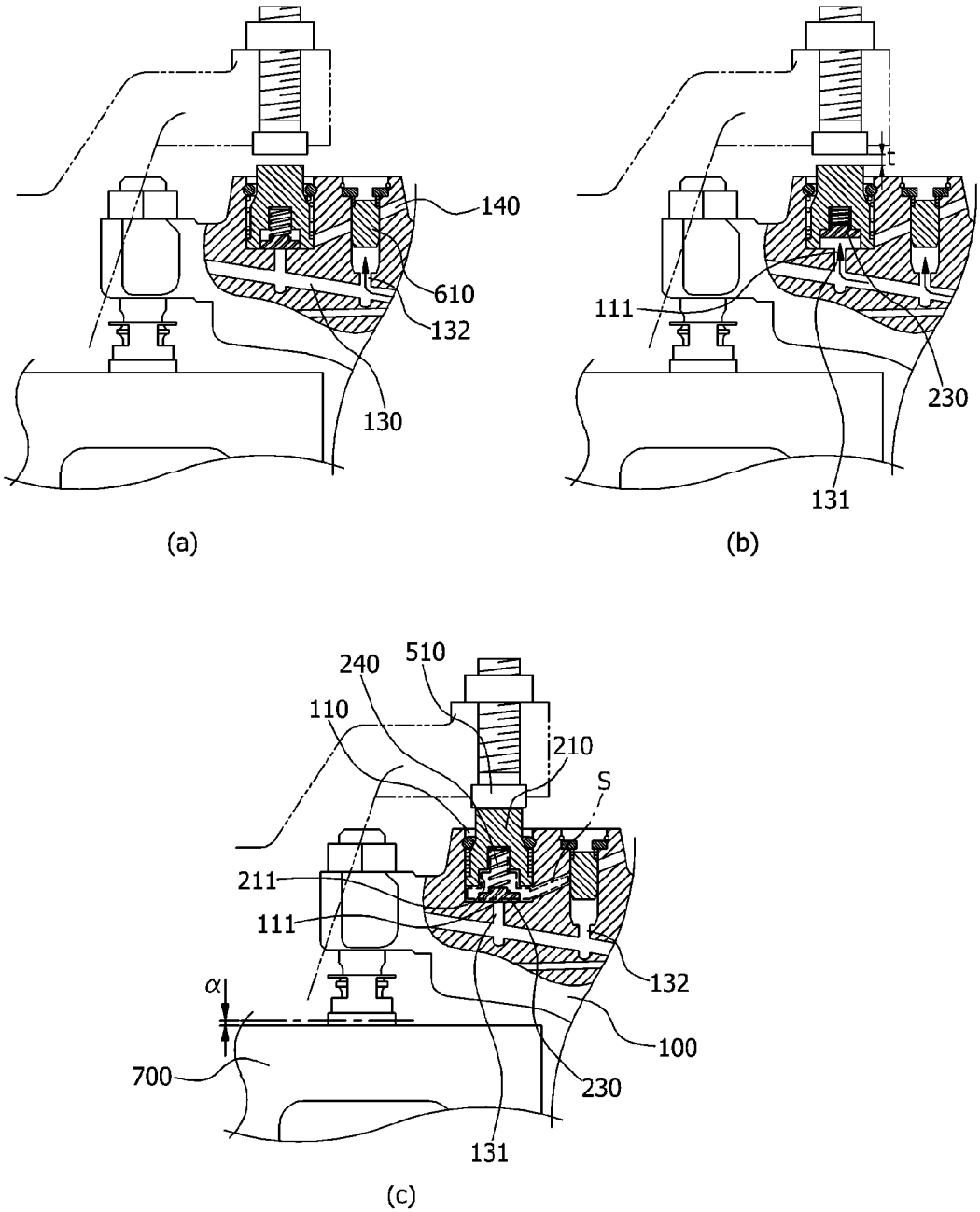
FIGS. 5 and 6 are cross-sectional views illustrating the operation of an exemplary engine braking system for vehicles according to the present invention.
Figure 6:
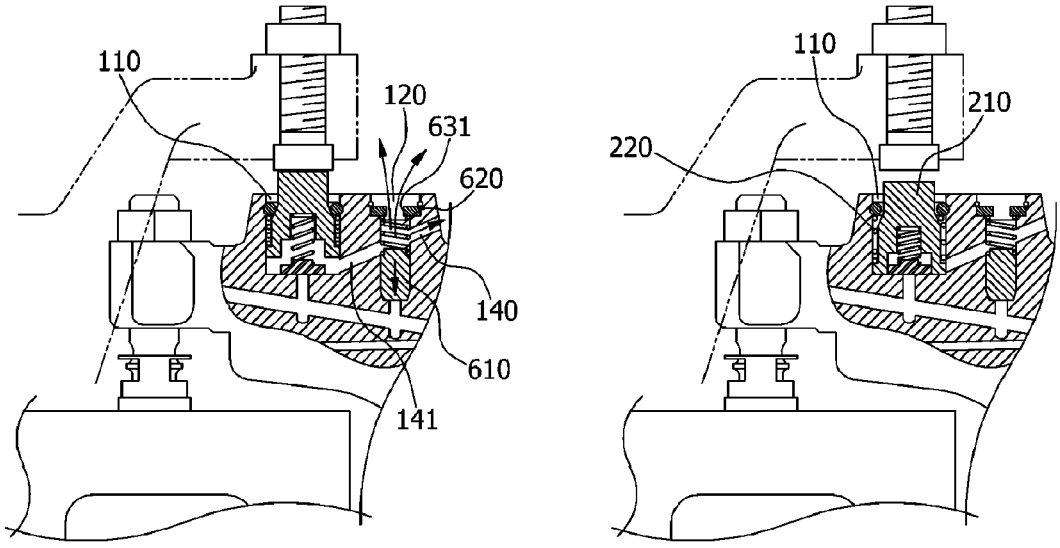

An operation of the engine braking system for vehicle having the above-mentioned configuration will be described with reference to FIGS. 5 and 6.

When an engine braking system is not in operation, no oil is supplied to the braking oil passage (not shown) through the solenoid valve (not shown). In this state, as in FIG. 6, the check ball 230 is pressed by the sub-elastic member 240, thereby closing the gate 111 of the recess. The pressing piston 210 is pressed toward the first channel 131 by the main elastic member 220, and the control piston 610 is pressed toward the second channel 132 by the elastic member 620.

Further, the stopper 510 is fixed above the recess 110 disposed apart from the upper end face of the pressing piston 210 by a gap t, so that, when the exhaust rocker arm 100 is pivoted, the stopper 510 is not in contact with the pressing piston 210.

In this state, when the driver operates the engine braking system, the oil is supplied to the braking oil passage 310 through the solenoid valve 400. The oil supplied to the braking oil passage 310 flows through the auxiliary passage 330, and is supplied to the recess 110 and the second recess 120 via the connection passage 130 of the exhaust rocker arm 100. Here, the braking oil is supplied to the second channel 132 prior to the first channel 131. Thus, the control piston 610 is raised to close the discharge passage 140 (FIG. 5A). Then, the braking oil is supplied to the first channel 131, so that the check ball 230 opens the gate 111 of the recess (FIG. 5B).

As the gate 111 of the recess is open, the braking oil flows into the reservoir 211 of the pressing piston, and the compressed sub-elastic member 240 is restored to press the check ball 230 toward the gate 111 of the recess. When the check ball 230 closes the gate 111 of the recess, a hydraulic pressure is generated in the recess, and thus the pressing piston 210 is raised to contact the stopper 510 (FIG. 5C).

In this manner, since the check ball 230 closes the gate 111 of the recess in the state where the oil flows in the recess 110, the hydraulic pressure can be constantly maintained in the recess 110.

Here, the recess 110, into which the braking oil is introduced and stored, has a smaller volume S compared to an existing space, so that the hydraulic pressure is generated at a higher speed. Thus, the pressing piston 210 is rapidly raised, so that the performance of the engine braking system is improved.

Furthermore, the pressing piston 210 is raised higher than the gap t between the pressing piston 210 and the stopper 510, and thus the displacement $\alpha$ is generated from the exhaust locker arm 100 by a value left by subtracting the gap t from the height to which the pressing piston 210 is raised. Here, it is preferable to adjust the gap to a proper value such that the valve 710 does not come into contact with the piston (not shown) in the cylinder due to the displacement of the exhaust locker arm 100.

In this manner, due to the displacement of the exhaust locker arm 100, the exhaust valve 710 is kept open when the engine braking system is operated, and thus the compression stroke does not occur. As a result, the vehicle is braked.

In this state, when the driver stops the operation of the engine braking system, the oil is no longer supplied to the braking oil passage through the solenoid valve, so that the control piston 610 is lowered. As the control piston 610 is lowered, the braking oil of the recess 110 flows into the upper portion of the control valve 610 housed in the second recess 120 through the connection passage 141, and then is discharged to the outside of the exhaust locker arm through the discharge passage 140 and the hole 631 of the plate (FIG. 6A).

When the braking oil introduced into the recess 110 is completely discharged, the pressing piston 210 is returned to its original position by the restoring force of the main elastic member 220 (FIG. 6B).

For convenience in explanation and accurate definition in the appended claims, the terms "upper", "lower", "inner", "interior", "outer", and "downwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine braking system for vehicles, comprising:

a rocker shaft having a lubricating oil passage and a braking oil passage therein in an axial direction thereof, wherein oil for lubricating engine parts on operating an engine flows through the lubricating oil passage and oil for operating an engine braking flows through the braking oil passage;

a valve unit selectively supplying part of the oil supplied to the lubricating oil passage, into the braking oil passage;

at least one exhaust rocker arm, into which the rocker shaft is inserted and pivotal about the rocker shaft to selectively press an exhaust valve, wherein the at least one exhaust rocker arm has, therein, a first connection passage communicating with the braking oil passage and a first recess formed in the at least one exhaust rocker arm;

a stopper fixed above the first recess of the at least one exhaust rocker arm with a predetermined gap therebetween; and an actuator housed in the first recess and including a pressing piston, wherein the pressing piston moves to contact the stopper by hydraulic pressure of the oil supplied from the braking oil passage into the first recess and thus presses one side of the at least one exhaust rocker arm in a downward direction;

wherein the predetermined gap is adjusted by moving the stopper; and wherein the stopper is mounted to at least one holder provided separately from the at least one exhaust rocker arm so as to be disposed apart from an upper end face of the pressing piston with the predetermined gap.

2. The engine braking system according to claim 1, wherein the actuator further includes:

a main elastic member elastically supporting the pressing piston toward a first channel formed in the at least one exhaust rocker arm and connecting the first connection passage and the first recess, wherein the pressing piston includes a reservoir therein;

a check ball disposed in the reservoir of the pressing piston and selectively movable to open or close a gate of the first connection passage;

a sub-elastic member disposed in the reservoir of the pressing piston and elastically supporting the check ball toward the gate of the first connection passage; and a first fixing member formed in an upper circumference of the first recess and supporting the main elastic member to prevent the main elastic member and the pressing piston from being separated from the first recess.

3. The engine braking system according to claim 2, wherein the first fixing member includes a first snap ring seated and fixed in a groove formed in an upper circumference of the first recess.

4. The engine braking system according to claim 2, wherein the at least one exhaust rocker arm includes:

a first discharge passage communicating with the first recess and the outside; and a control valve unit opening or closing the first discharge passage so as to selectively discharge the oil in the first recess to the outside according to the hydraulic pressure of the oil in the first connection passage.

5. The engine braking system according to claim 4, wherein the control valve unit is disposed in a second recess formed in the at least one exhaust rocker arm and passing through the first discharge passage to intersect therebetween, and wherein the first recess and the first discharge passage communicate through a second connection passage formed in the at least one exhaust rocker arm.

6. The engine braking system according to claim 5, wherein a second channel is formed between the second recess and the first connection passage and the hydraulic pressure of the oil in the first connection passage is applied to the control valve unit through the second channel.

7. The engine braking system according to claim 6, wherein the second recess is disposed closer to the braking oil passage than the first recess is.

8. The engine braking system according to claim 4, wherein the control valve unit includes:

a control piston slidably disposed in the second recess and moving in a lengthwise direction thereof to selectively open or close the first discharge passage according to the hydraulic pressure of the oil in the first connection passage, the hydraulic pressure being applied to the control piston through the second channel;

an elastic member disposed in the second recess and applying an elastic force to the control piston in a direction where the control piston opens the first discharge passage; and a second fixing member fastening the elastic member in the second recess and having a second discharge passage to selectively discharge the oil supplied from the first recess to the outside.

9. The engine braking system according to claim 8, wherein the second fixing member includes:

a plate having a hole therein to form the second discharge passage and supporting the elastic member downwards in the second recess to prevent the elastic member and the control piston from being separated from the second recess; and a second snap ring seated in a groove formed in an upper circumference of the second recess, and supporting the plate.

10. The engine braking system according to claim 1, wherein the stopper is integrally formed with a screw screwed to the at least one holder such that the predetermined gap between an end of the stopper and the upper end face of the pressing piston can be adjusted.

11. The engine braking system according to claim 10, wherein at least two holders are integrally connected and mounted on a cylinder head.

12. The engine braking system according to claim 1, wherein the rocker shaft includes:

a flow-through passage formed in a direction intersecting with the axial direction of the lubricating oil passage, and connected to the valve unit; and an additional passage formed in a direction intersecting with the axial direction of the braking oil passage, and connected to the valve unit.

13. The engine braking system according to claim 1, wherein the first connection passage communicates with the braking oil passage through an auxiliary passage formed in the rocker shaft.

* * * * *